United States Patent [19]

Kurita et al.

[11] 4,399,493

[45] Aug. 16, 1983

[54] ILLUMINATED ARTIFICIAL FLOWER ORNAMENT

[75] Inventors: Yoshihiko Kurita; Naotaka Uchida, both of Tokyo, Japan

[73] Assignee: Nihon Dennetsu Co., Ltd., Tokyo, Japan

[21] Appl. No.: 336,613

[22] Filed: Dec. 30, 1981

[51] Int. Cl.[3] ..... F21P 1/02

[52] U.S. Cl. ..... 362/122; 362/252; 362/806

[58] Field of Search ..... 362/122, 252, 806

[56] References Cited

U.S. PATENT DOCUMENTS 3,146,955 9/1964 Sabuco ..... 362/122

4,171,754 10/1979 Rosado ..... 362/122

*Primary Examiner*—Stephen J. Lechert, Jr.

*Attorney, Agent, or Firm*—Armstrong, Nikaido, Marmelstein & Kubovcik

[57] ABSTRACT

An artificial-flower ornamental ware which can be illuminated is disclosed, in which conductors disposed in a peduncle part of an artificial flower having a miniature lighting bulb are coaxially arranged and contact points of an electrode in which the peduncle part is plugged are provided in a vertically spaced manner, and with which the peduncle part is plugged in the electrode free of a specific position or rotational direction in which the peduncle part is at the time of plugging.

8 Claims, 16 Drawing Figures

ILLUMINATED ARTIFICIAL FLOWER ORNAMENT

BACKGROUND OF THE INVENTION

The present invention relates to an illuminated artificial flower ornament and, more particularly, an improved illuminated imitation flower ornament which can be manufactured with an advanced ease and can possess an improved reliability in use.

Illuminated artificial flowers generally comprise a petals part in which a midget electric bulb is supported in a manner of being surrounded by a plurality of flower petals and a peduncle part supporting inside thereof electric conductors connected to lead wires from the electric bulb. In an example of existing artificial flower ornaments of the sort under consideration, a pair of conductors are made of sheet or plate members which are disposed parallel to the axis of the peduncle part. In manufacturing the artificial flower of this example, the conductors must always be plugged for connection with respective electrodes inconveniently in only a certain fixed direction or position, and the efficiency of the operation for plugging the peduncle part relative to electrodes is therefore considerably inconvenienced with the result that the production efficiency can hardly be improved. Further, in case the plugging is made in a wrong way as is likely attributable to the above indicated limitation in the plugging direction or position of the peduncle part, accidents are prone to take place in use of the ornament such as a contact failure, a short at electrodes and so forth, and with the today products, they often fail to possess a full reliability or stability in use. Also, it sometimes is desired to bend the peduncle part taking after shapes of live flower stalks, but with the today products in reference, directions in which their stalks parts can be bent are only limited.

Then, in another example of existing illuminated imitation flower ornaments, a pair of copper wires are embedded in a parallel arrangement in the peduncle or stalk part molded from a synthetic resin. With artificial flowers of this example, it tends to occur that their flower stalk part is too thick to be desirably balanced in size with their petals part. Also in this case, the copper conductor wires are parallel disposed, and the peduncle part is again under a limitation with respect to the direction or position in which it is plugged relative to electrodes.

SUMMARY OF THE INVENTION

Accordingly, it is contemplated according to the present invention to obviate various inconveniences and shortcomings as above indicated in connection with the today art of the manufacture of illuminated artificial flower ornaments.

A primary object of the present invention is therefore to provide an illuminated artificial flower ornament of which the assemblage of an artificial flower to be illuminated and an electrode support stand therefor can be operated free of a limitation in the direction or position in which the artificial flower is plugged, and which can therefore be manufactured at an improved production efficiency and can possess an enhanced reliability in use.

It also is an object of the present invention to provide an illuminated artificial ornament of which the peduncle part can be freely bent taking after stalks of natural or live flowers.

These and other objects which will appear as the description proceeds in what follows are attained according to the present invention by providing an illuminated artificial flower ornament which comprises an artificial flower composed of a petals part having lighting means disposed in a central portion thereof, a core member including a coaxially arranged pair of conductors connected to the lighting means and a peduncle or stalk part including the core member inside thereof, capable of being freely bent, and an electrode support stand for the artificial flower provided with vertically spaced contact points with which the core member is releasably connected.

According to the present invention, the pair of conductor supported inside the peduncle part are in a coaxial arrangement, so that they can be plugged in the electrode of the support stand free of a care concerning their plugging direction or position, wherefore the efficiency of the operation for plugging the peduncle part into the electrode and accordingly the overall production efficiency can be enhanced and, at the same time, the product reliability can be improved.

Also, conductors are coaxially arranged in the stalk part in accord with the invention, and the stalk part can therefore be bent without any inconvenience in any optional way copying the flower stalk of a natural flower.

Such and other objects, features and advantages of the present invention will become more apparent from considering the following description taken in conjunction with the accompanying drawings.

DETAILED DESCRIPTION OF THE PREFERRED EMBODIMENTS

Figure 1:
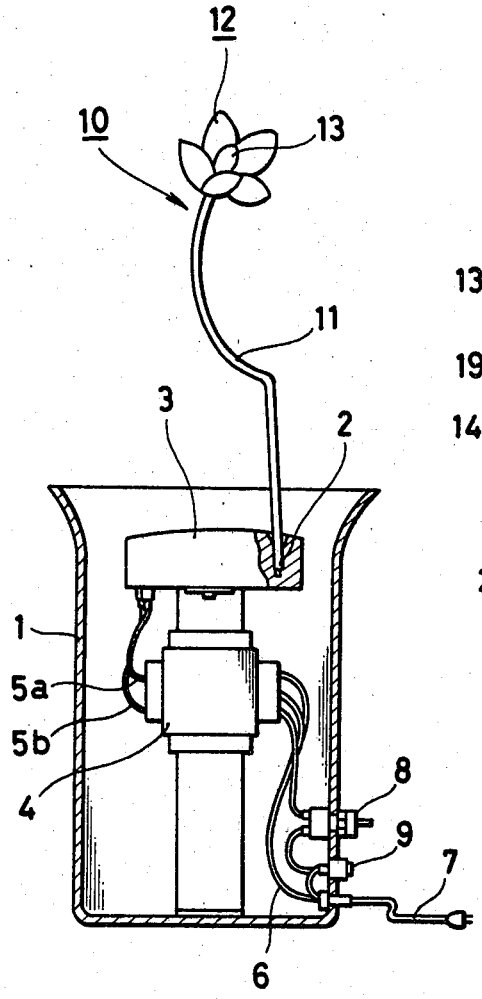
FIG. 1 shows partly in section an overall view of an illuminated artificial flower ornament embodying the present invention.

Indicated at 1 in FIG. 1 is a vessel like a flowerpot, which is made of a wood or wooden material or from ceramic or synthetic resin and in which an electrode support stand 3 having an electrode 2 embedded therein is securely received. The reference numeral 4 denotes a transformer, of which secondary lead wires 5*a* and 5*b* are connected to the electrodes 2, while primary lead wires 6 being connected to a connector-provided cord 7 and can be connected to a power source (not shown) through the cord 7. Reference characters 8 and 9 respectively represent a switch and a safety fuse.

Figure 9:
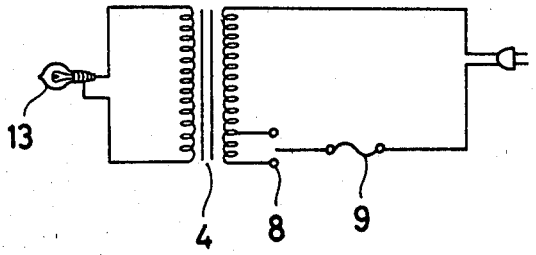
FIG. 9 shows a somewhat schematic circuit diagram for illumination.

In the electrode 2 embedded in the support stand 3, the peduncle or stalk part 11 of a bulb-provided artificial flower or illuminated artificial flower 10 is plugged. In use, the cord 7 is connected to a power source and the switch 8 may be put in, whereby lighting means represented by the midget bulb indicated at 13 and received in a petal assembly 12 will be energized to light. The electric circuit for energizing and de-energizing the bulb 13 may basically be as shown in the diagram of FIG. 9. It may be apparent to those skilled in the art that although the illustration in FIG. 9 takes an example of alternate current power sources, the power source may alternatively comprise a dry cell.

Figure 2:
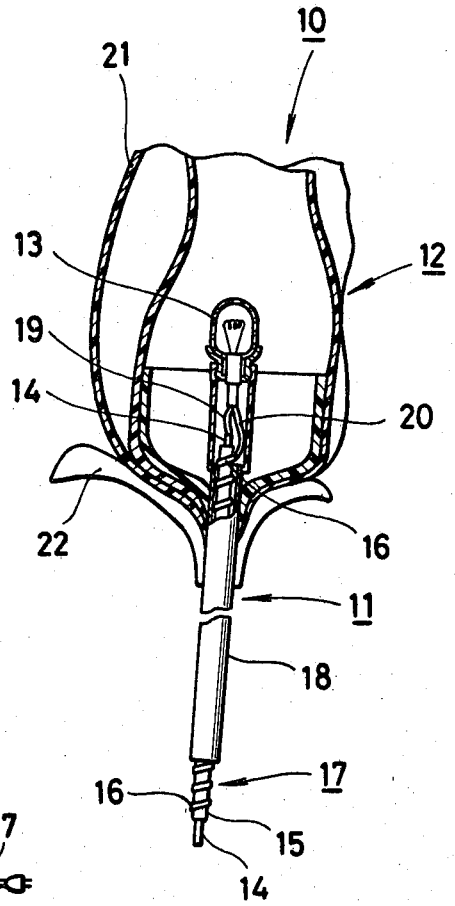
FIG. 2 is a partly sectional side elevational view, showing a first example of the illuminated artificial flower according to the invention.

FIG. 2 shows a partly sectional side elevation of the artificial flower 10, and as shown, a core member 17 is structured by a conductor wire 14 comprising a metal wire having a suitable rigidity and a high conductivity such as a copper wire for example, an insulator 15 covering the conductor wire 14, and a ribbo-like conductor 16 made of for example copper, which is helically wound over the insulator 15. Further, this core member 17 is covered with a colored tape 18 of a synthetic resin or paper to form the peduncle part 11.

The miniature bulb 13 is connected to a top end portion of the peduncle part 11. In effecting such connection, for example it may be operated to connect one lead wire 19 of the bulb 13 to the conductor wire 14, while connecting the other lead wire 20 to the ribbon-like conductor 16.

Then, the petals part 12 is composed of a plurality of petals 21 arranged to radially cover the bulb 13 and calyces 22, which altogether are secured at an upper end portion of the stalk part 11.

Figure 3:
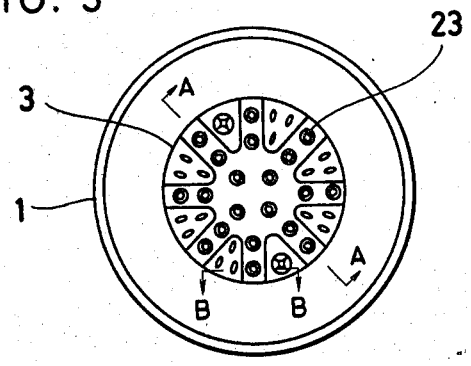
FIG. 3 shows a plan view of a flowerpot or a like vessel in the ornament of FIG. 1.
Figure 4:
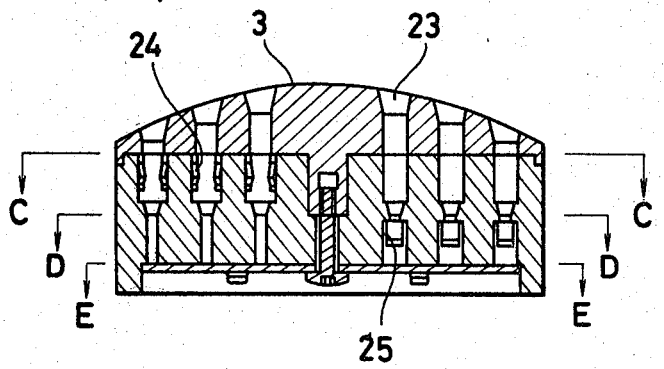
FIG. 4 is a sectional view taken along line A—A of FIG. 3.
Figure 5:
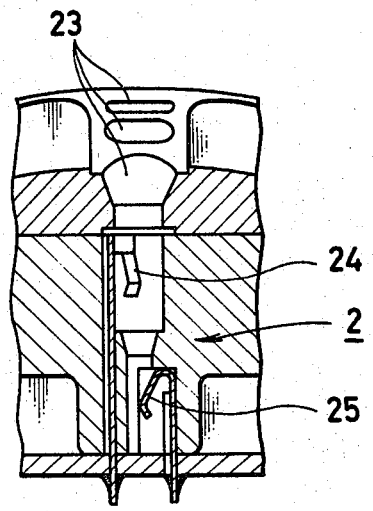
FIG. 5 is a sectional partial view taken along line B—B of FIG. 3.

As shown in the plan view of FIG. 3, in the support stand 3 there are formed a number of holes 23 for therein receiving and supporting the peduncle or stalk part 11, which are provided in a radially spaced arrangement. Then, as shown in FIG. 5, in the hole 23, a pair of contacts 24 and 25 of the electrode 2 are provided in a vertically spaced arrangement so that when the stalk part 11 is inserted in the hole 23, the helically disposed ribbon-like outer conductor 16 may contact the upper located contact point 24, while the centrally disposed inner conductor 14 contacting the lower located contact point 25.

Figure 6:
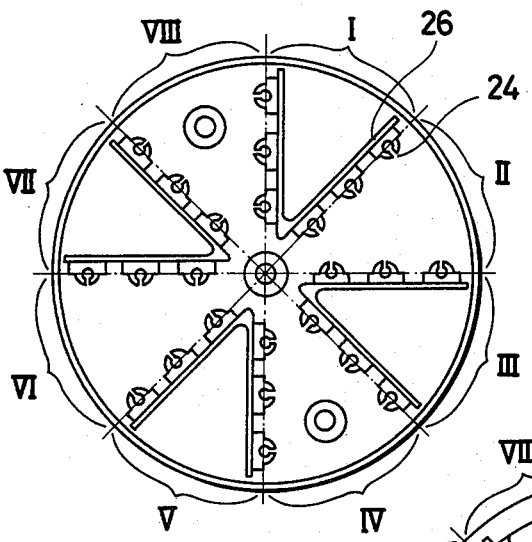
FIG. 6 is a sectional view taken along line C—C of FIG. 4.
Figure 7:
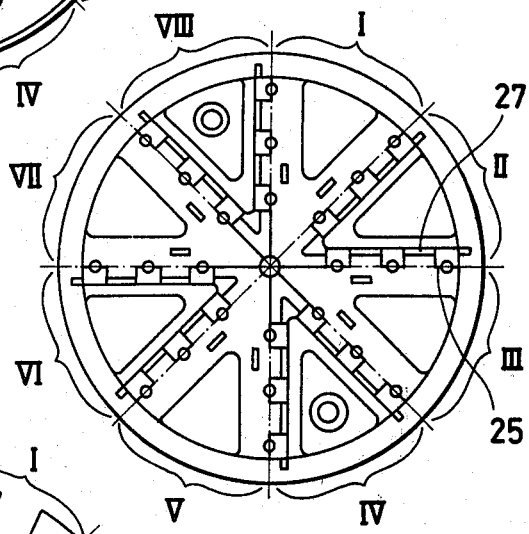
FIG. 7 is a sectional view taken along line D—D of FIG. 4.

As shown in FIG. 6, a number of contact points 24 are provided at the prescribed intervals on V-shaped base plates 26, which are provided in these segments of a circle in plan view of the vessel 1 which are indicated at I, III, V and VII. Similar to the above and as shown in FIG. 7, a number of lower contact points 25 are formed also with the prescribed interspaces on V-shaped base plates 27, which are provided in sections II, IV, VI and VIII.

Figure 8:
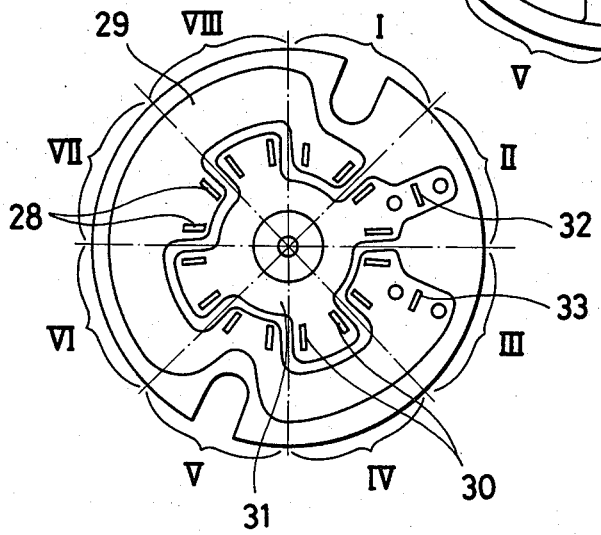
FIG. 8 is a sectional view taken along line E—E of FIG. 4.

As shown in FIG. 8, further, with base plates 26, their lower end portions or legs (not shown) are received in holes 28 formed in a conductive terminal plate 29, and with base plates 27, their leg portions (not shown) are received in holes 30 in another conductive terminal plate 31. The terminal plates 29 and 31 are provided also with holes 33 and 32 respectively, in which the previously mentioned lead wires 5*a* and 5*b* from the transformer 4 are received and stopped respectively.

As stated above, conductors 14 and 16 of the core member 17 of the flower stalk part 11 are in a coaxial arrangement, therefore the part 11 can be plugged in the electrode 2 embedded in the support stand 3 without the need of exerting a particular care to ascertain a specific position or rotational direction in which the part 11, that is, the core member 17 is at the time of the plugging relative to the electrode. Thus, the operation for plugging the stalk part 11 in the electrode 2 can be greatly facilitated, and the operation efficiency and accordingly the production efficiency can be enhanced. Also, inasmuch as the core member 17 comprises coaxially arranged components, the peduncle or stalk part 11 can be bent without any limitation in the direction of bending so as to closely resemble a bent shape of the flower stalk of a natural flower.

Figure 10:
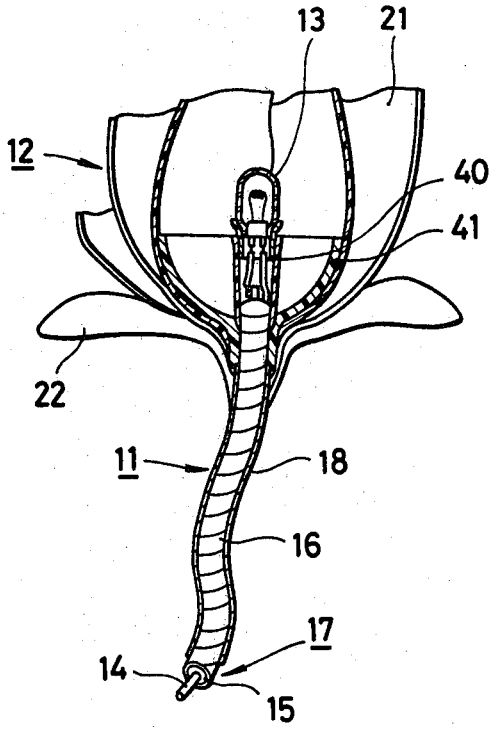
FIG. 10 is a view similar to FIG. 2 and shows a second example of the illuminated artificial flower of the invention.
Figure 11:
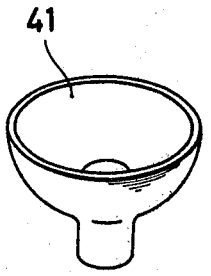
FIG. 11 is a perspective view of a support member for flower petals.

FIG. 10 shows a secod embodiment of the artificial flower according to the present invention, and in this example, an improved appearance of the flower is obtained by way of applying a covering of a colored flexible tube 40 in this portion of the flower which lies between a lower end portion of the electric bulb 13 and an upper end portion of the peduncle part 11. Also, a cup-like member 41 as illustrated in FIG. 11 is secured to an upper end portion of the peduncle part so that the petals 21 can be prevented by the member 41 from contacting the bulb 13 and then undergoing a color change. Also, the member 41 can function to make the petals 21 more like a natural flower in appearance.

Figure 13:
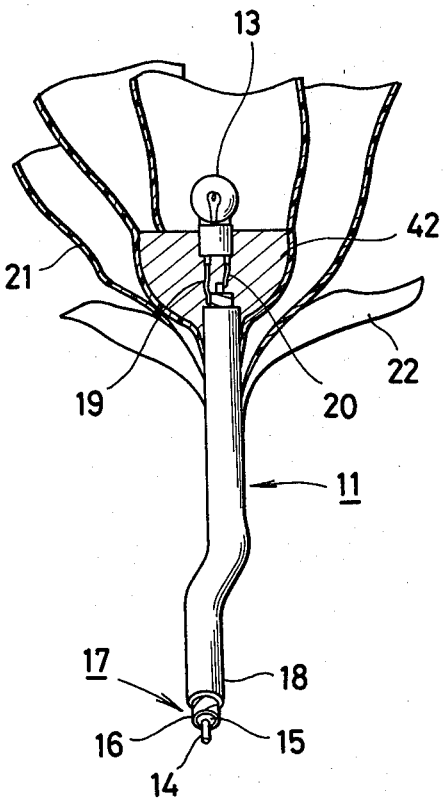
FIG. 13 is a view similar to FIGS. 2 and 10 and shows a third example of the illuminated artificial flower according to the invention.

In the further example shown in FIG. 13 of the illuminated imitation flower of the invention, a portion of the flower lying between a lower end portion of the bulb and an upper end portion of the stalk part 11 is buried in a support member 42 of a transparent synthetic resin so that the above described tube 40 and cup-like member 41 are both effectively dispensed with.

Figure 14:
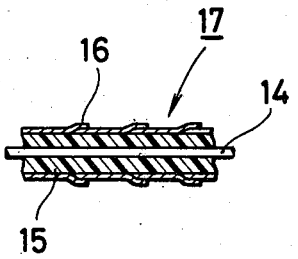
FIG. 14 is an enlarged sectional view, showing a modified example of the core member of the illuminated artificial flower according to the invention.

FIG. 14 shows a modified example of the core member 17, and in this example, the ribbon-like conductor 16 is helically wound over the insulator 15 in an edge ovelapping manner. With the core member 17 of this example employed in the peduncle part 11, the latter can be bent with no substantial inter-edge gap produced of the conductor ribbon 16.

Figure 15:
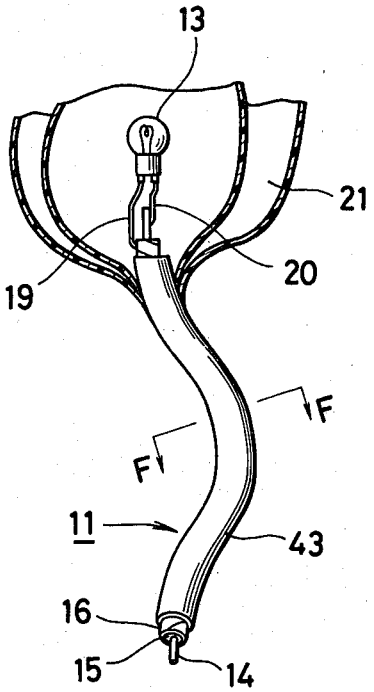
FIG. 15 is a similar view to FIGS. 2, 10 and 13 and illustrates a fourth example of the illuminated artificial flower of the invention.
Figure 16:
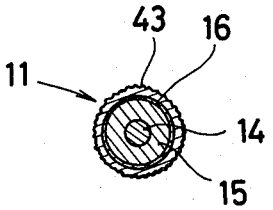
FIG. 16 shows a sectional view taken along line F—F of FIG. 15.

In FIGS. 15 and 16, which together show a still further embodiment of the artificial flower in accordance with the concept of the present invention, the peduncle part 11 has an outer surface made of a synthetic resin and is formed axially on its outer surface with linear ridges 43, whereby it can produce a light reflection closely resembling that the stem of a natural flower will produce.

Figure 12:
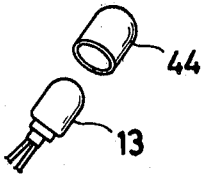
FIG. 12 shows a perspective view, taken for illustration of an instance in which a cap is applied on the electric bulb.

When petals 21 are of a white coloring, it may be devised to paint or otherwise color the miniature bulb 13 in blue green or in any other color. Alternatively, a colored cap 44 as shown in FIG. 12 may be applied over the bulb 13. This cap 44 may be made of a suitable material such as a silicon resin, vinyl chloride resin and may be suitably colored so as to there obtain a coloring effect as closely natural as possible. It may be readily understood that the electric bulb 13 may be effectively replaced by a luminescent semiconductor diode or any other digital indicator member.

We claim:

1. An illuminated artificial flower ornament comprising:

a support stand positioned in a flower pot-like vessel, the support stand being provided with a number of holes, electrode means disposed in each of said holes and electrically connected to an electrical power source, and an artificial flower having a peduncle part in a top end portion thereof, the peduncle part having lighting means electrically connected to said electrode means through a core member in said peduncle part, said artificial flower being releasably fitted in any one of said holes, said core member comprising a linear conductor, an insulator covering said linear conductor and a ribbon-like conductor helically wound around insulator in a coaxial arrangement, said electrode means having a contact point for electrically connecting said ribbon-like conductor and another contact point for electrically connecting said linear conductor, said contact point being spaced from said another contact point along the longitudinal direction of said core member.

2. An illuminated artificial flower ornament, as claimed in claim 1, in which said holes and said core member have a circular cross-section, and said contact point and said another contact point of said electrode means are spaced in the axial direction of said hole, so that said core member is rotatably mounted in said support stand while being electrically connected to said electrical power source.

3. An illuminated artificial flower ornament, as claimed in claim 1, in which said contact point and said another contact point of said electrode means are quickly releasable, so that said artificial flower is unplugable from said holes.

4. An illuminated artificial flower ornament, as claimed in claim 1, wherein said linear conductor has a suitable rigidity.

5. An illuminated artificial flower ornament as claimed in claim 1, in which said ribbon-like conductor is helically wound on said insulator in an edge overlapping manner.

6. An illuminated artificial flower ornament as claimed in claim 1, in which a part of the artificial flower lying between a lower end portion of said lighting means and an upper end portion of said peduncle part is covered with a flexible tube.

7. An illuminated artificial flower ornament as claimed in claim 1, in which a part of said artificial flower lying between a lower end portion of said lighting means and an upper end portion of said peduncle part is buried in a support member of a synthetic resin.

8. An illuminated artificial flower ornament as claimed in claim 1, in which said peduncle part has an outer surface made of a synthetic resin and is formed axially on said outer surface with linear ridges.

* * * * *